US007268285B2

(12) United States Patent
Shimomuku et al.

(10) Patent No.: US 7,268,285 B2
(45) Date of Patent: Sep. 11, 2007

(54) KEY STRUCTURE AND KEYBOARD APPARATUS

(75) Inventors: Yoichirou Shimomuku, Hamamatsu (JP); Kenichi Nishida, Hamamatsu (JP); Ichiro Osuga, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 90 days.

(21) Appl. No.: 10/938,924

(22) Filed: Sep. 9, 2004

(65) Prior Publication Data

US 2005/0056136 A1 Mar. 17, 2005

(30) Foreign Application Priority Data

Sep. 12, 2003 (JP) ..... 2003-320965
Apr. 16, 2004 (JP) ..... 2004-121734

(51) Int. Cl.
*G10C 3/12* (2006.01)

(52) U.S. Cl. ..... 84/433; 84/423 R

(58) Field of Classification Search ..... 84/433, 84/423 R, 432, 438, 254, 255, 236, 237
See application file for complete search history.

(56) References Cited

U.S. PATENT DOCUMENTS 2,844,065 A * 7/1958 Corwin ..... 84/423 R
3,120,146 A * 2/1964 Stiles ..... 84/433
3,417,649 A * 12/1968 Wood ..... 84/433
3,756,113 A * 9/1973 Suzuki et al. ..... 84/438
4,512,234 A * 4/1985 Kumano ..... 84/433
4,840,104 A * 6/1989 Ishida et al. ..... 84/437
5,559,297 A 9/1996 Yoshikawa et al.
6,693,235 B2 * 2/2004 Ookubo ..... 84/433
2005/0145093 A1 * 7/2005 Nishida et al. ..... 84/433

FOREIGN PATENT DOCUMENTS

JP 2514485 7/1996
JP 2903959 3/1999

* cited by examiner

*Primary Examiner*—Gary F. Paumen
(74) *Attorney, Agent, or Firm*—Morrison & Foerster LLP

(57) ABSTRACT

A key structure which has a key formed by a wood part so as to present a woody appearance and which makes it possible to prevent support members thereof that support the wood part from being damaged during machining of the wood part for width adjustment. The key structure functions as a key pivotally moved by key depression when it is mounted in a keyboard apparatus. A wood part includes a narrow part having opposite lateral sides. An elongated upper plate body has opposite lateral sides, and fixedly supports the wood part. Recessed parts are formed in the respective lateral sides of the upper plate body at least in a substantial entirety of a region of the upper plate body in a longitudinal direction of the key structure where the wood part does not exist. The recessed parts are recessed laterally inward of the respective lateral sides of the narrow part of the wood part.

9 Claims, 3 Drawing Sheets

KEY STRUCTURE AND KEYBOARD APPARATUS

BACKGROUND OF THE INVENTION

1. Field of the Invention

The present invention relates to a key structure which is applied to a key having a wood part, and a keyboard apparatus including the key structure.

2. Description of the Related Art

Conventionally, key structures are known which function as a key pivotally moved by key depression and for which wood or the like is used, as disclosed in Japanese Utility Model Registration Publication No. 2514485 and Japanese Laid-Open Patent Publication (Kokai) No. 2903959. In such a woody key structure, a woody material is used at least for a so-called "visible part" which is visible from the outside during both performance and non-performance, the key structure presents a woody appearance and hence a high-quality appearance.

In the woody key structure, the wood part is supportedly fixed e.g. using an adhesive to the lower surface of an upper plate member having a depressing surface, or to the upper surface of a key base body as a lower plate member. The support members, such as the upper plate member and the key base body, have elongated shapes corresponding to the shape of the key, and these support members and the wood part form the key structure.

Differently from synthetic resin which can be accurately shaped by molding, wood, which cannot be molded, is formed into a desired shape basically by cutting or machining. For example, to make the width of the key structure equal to a predetermined width set for each key of the keyboard apparatus, it is necessary to cut or machine the left and right sides of the key structure which includes the wood part. In this operation, generally, the key structure is cut for width adjustment using a cutting tool, such as a rotary tool, which is moved in the longitudinal direction along the key structure, so as to make the width of the key structure uniform along the length thereof.

However, the key structure may include a region in the longitudinal direction where no wood part exists, e.g. as in the case where the key structure has a rear end part formed of only resin without any wood part. When the cutting tool moves along such a region of the key structure as the above-mentioned rear end part where only a resin part exists without any wood part, the cutting blade of the cutting tool is brought into contact with a wide region of the resin part. Machining conditions suited to resin parts are different from those suited to wood parts, and therefore the edge of the cutting blade tends to cut undesirably deep into the resin part to cause damage, such as cracking or chipping, to the resin part.

Further, depending on the shape of a bonded part between the wood part and the support member, the rigidity of the key structure itself can be low or the rigidity can vary along the length of the key structure, so that stress can be concentrated on parts low in rigidity, i.e. weak parts, which can cause a deformed or damaged key structure. For example, when an appropriate clearance having a longitudinal component is provided between the wood part and the support member so as to accommodate variations in the longitudinal dimensions of the two parts, the clearance can produce the least rigid part of the key structure. Such a discontinuity in rigidity of the key structure is undesirable since it brings about the reduced rigidity of the key. In spite of these circumstances, there is a constant demand for the reduction of sizes and weights of keys and keyboard apparatuses.

SUMMARY OF THE INVENTION

It is a first object of the present invention to provide a key structure which has a key formed by a wood part so as to present a woody appearance and which makes it possible to prevent support members thereof that support the wood part from being damaged during machining of the wood part for width adjustment, and a keyboard apparatus having the key structure.

It is a second object of the present invention to provide a key structure which has a key formed by a wood part so as to present a woody appearance and which makes it possible not only to reduce the longitudinal size of the key structure, but also to achieve enhancement and uniformity of rigidity of the key structure in the longitudinal direction, and a keyboard apparatus having the key structure.

To attain the above first object, in a first aspect of the present invention, there is provided a key structure (600, 700) that is mounted in a keyboard apparatus, for functioning as a key pivotally moved by key depression, comprising a wood part (111, 115) that includes a narrow part (111M, 115M) having opposite lateral sides (111*a*, 111*b*, 115*a*, 115*b*), and an elongated support member (110, 116) that has opposite lateral sides (110*c*, 110*d*, 116*c*, 116*d*), and fixedly supports the wood part, and the support member has recessed parts (110*a*, 110*b*, 116*a*, 116*b*) formed in the respective lateral sides thereof at least in a substantial entirety of a region (AR1, AR3) of the support member in a longitudinal direction where the wood part does not exist, the recessed parts being recessed laterally inward of the respective lateral sides of the narrow part of the wood part.

With the arrangement of the first aspect of the present invention, the key presents a woody appearance due to the wood part. Further, the recessed parts are formed in the opposite lateral sides of the support member in the substantial entirety of the region where the wood part does not exist, in a manner being recessed laterally inward of the narrow part of the wood part, which makes it possible to prevent the blade of the cutting tool from being brought into contact with the support member during machining of the wood part for width adjustment.

Preferably, the wood part includes an upper part, and the support member comprises an upper plate part that has a top surface used as a depressing surface, and is disposed on the upper part of the wood part, and a key base body that supports the wood part from below, the key base body having a shape in plan view such that the key base body is applicable to any of keys for a pitch A, a pitch C, a pitch E, and a pitch G, as non-dash keys which are disposed in positions other than opposite ends of the keyboard apparatus, the key base body being configured for use in both any of dash keys for the pitch A, the pitch C, the pitch E, and the pitch G, disposed at the opposite ends of the keyboard apparatus, and any of the non-dash keys, in a manner such that the key base body selectively supports the wood part and the upper plate part that are configured for the dash keys, and the wood part and the upper plate part that are configured for the non-dash keys.

To attain the above second object, in a second aspect of the present invention, there is provided a key structure (600, 700, 800) that is mounted in a keyboard apparatus, for functioning as a key pivotally moved by key depression, comprising a wood part, an elongated support member that has a rear part, and fixedly supports the wood part, and a rib (112, 117, 217) that has opposite lateral side surfaces vertically in substantial parallel relationship with each other and extends from the rear part of the support member toward a player side and the wood part, and the wood part has a recess (113, 118, 218) formed therein, in which the rib is fitted or received.

With the arrangement of the second aspect of the present invention, the key presents a woody appearance due to the wood part. Further, the support member is formed with the rib, and therefore the rigidity of the support member in the longitudinal direction is enhanced and made more uniform. Furthermore, the rib is received in the recess of the wood part, which enables space saving mainly in the longitudinal direction of the key structure, compared with a structure in which the rib is not received in the wood part.

To attain the above second object, in a third aspect of the present invention, there is provided a key structure (600, 700, 800) that is mounted in a keyboard apparatus, for functioning as a key pivotally moved by key depression, comprising an elongated support member that has a rear part, a wood part that is fixedly supported by the support member, the wood part being disposed at a location forward of the rear part of the support member such that the wood part extends toward a player side, with a clearance (CL1, CL3, CL5) provided between the rear part of the support member and the wood part, the clearance having a longitudinal component, and a rib (112, 117, 217) that has opposite lateral side surfaces vertically in substantial parallel relationship with each other and extends from the rear part of the support member, toward the player side and the wood part at least in the clearance, and the wood part has a recess (113, 118, 218) formed therein, in which the rib is fitted or received.

With the arrangement of the third aspect of the present invention, the key presents a woody appearance due to the wood part. Further, the support member is formed with the rib, and therefore the rigidity of the support member in the longitudinal direction is enhanced and made more uniform. Furthermore, the rib is received in the recess of the wood part, which enables space saving mainly in the longitudinal direction of the key structure, compared with a structure in which the rib is not received in the wood part. Moreover, the rib extends at least in the clearance between the wood part and the support member, the weakest part of the key structure can be effectively reinforced.

Preferably, at least one of thickness of the rib in a vertical direction thereof and thickness of the rib in a transverse direction of the key increases toward a rear end of the rib.

With the arrangement of the preferred embodiment, it is possible to disperse stress in the longitudinal direction, thereby making the key structure further uniform in rigidity. Also, when the thickness of the rib in the transverse direction of the key (in the transverse direction) is increased toward the rear end of the rib, it is possible to enhance torsional rigidity of the key structure, thereby increasing rolling resistance of the same. For example, the rib is formed into a trapezoidal shape in plan view with a base side in the rear of the key, and a shape in side view, in which the lower and upper ends of the rib are sloped downwardly and upwardly toward the rear end, respectively. Furthermore, this key structure makes it possible to minimize the recess of the wood part, thereby reducing the amount of machining of the recess.

Preferably, thickness of the rib in a transverse direction of the key increases toward the support member.

With the arrangement of the preferred embodiment, it is possible to prevent concentration of distortion due to a load in a rolling direction on a particular part of the key structure, thereby making uniform the rolling resistance of the same.

More preferably, the support member comprises an upper plate part that includes a top surface for use as a depressing surface, and is disposed on the upper part of the wood part, and a key base body that supports the wood part from below, and the rib is formed such that the rib extends from the key base body, but does not reach the upper plate part.

With the arrangement of the preferred embodiment, as is distinct from the case where the rib is continuous with the upper plate part, a sink mark formed at the root of the rib appears not on the top surface of the key structure, but on the lower surface of the key base body. Therefore, it is possible to prevent a sink mark from being formed on the visible portion visible from the outside to thereby avoid degradation of the appearance of the visible part.

To attain the above first object, in a fourth aspect of the present invention, there is provided a keyboard apparatus comprising keys having a key structure according to the first aspect of the invention.

To attain the above second object, in a fifth aspect of the present invention, there is provided a keyboard apparatus comprising keys having a key structure according to the second aspect of the invention.

To attain the above second object, in a sixth aspect of the present invention, there is provided a keyboard apparatus comprising keys having a key structure according to the third aspect of the invention.

The above and other objects, features, and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1A:
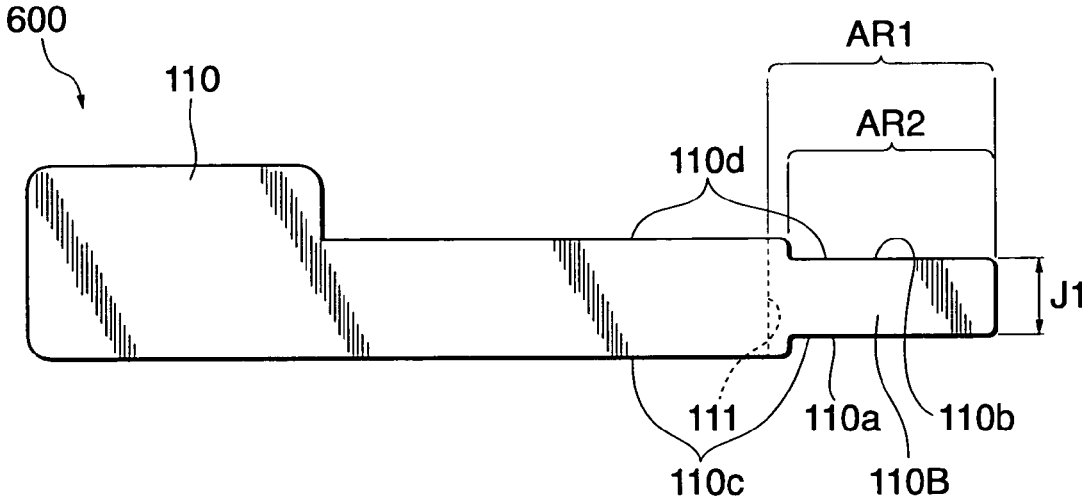
FIG. 1A is a plan view of a key structure according to a first embodiment of the present invention.
Figure 1B:
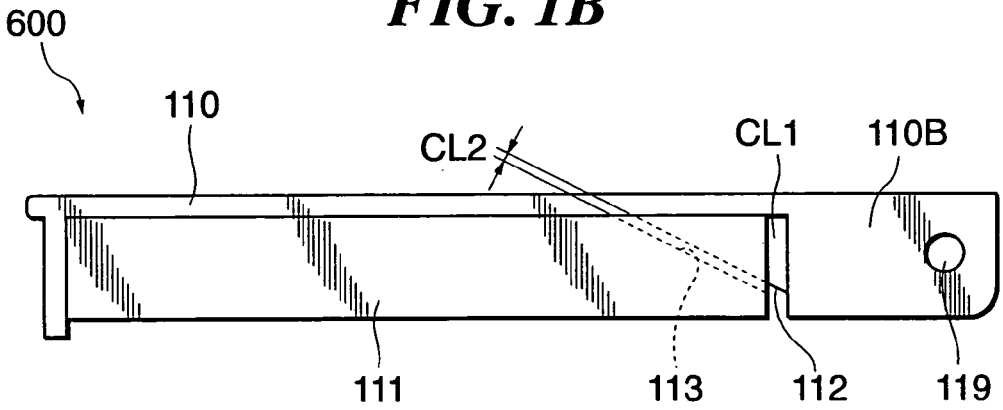
FIG. 1B is a right side view of the key structure according to the first embodiment.
Figure 1C:
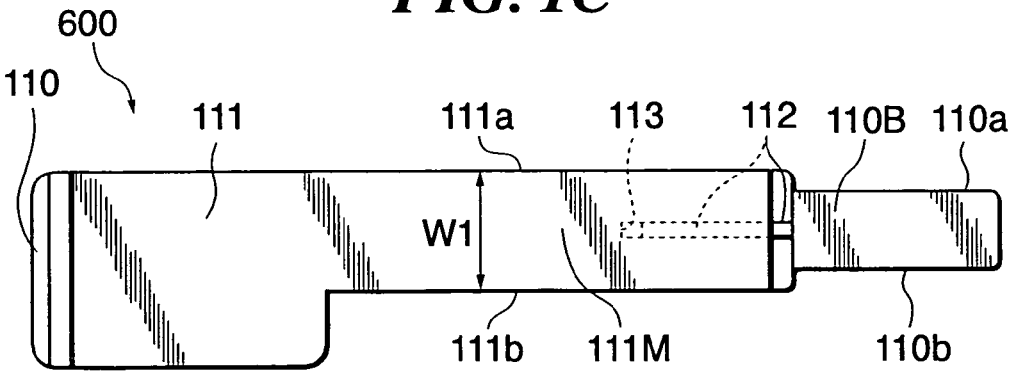
FIG. 1C is a bottom view of the key structure according to the first embodiment.

FIG. 1A is a plan view of a key structure according to a first embodiment of the present invention. FIG. 1B is a right side view of the key structure, and FIG. 1C is a bottom view of the same.

The key structure 600 according to the first embodiment functions as one of a plurality of keys of a keyboard apparatus used mainly as a musical instrument (musical keyboard instrument), which are pivotally moved by key depression. The key structure 600 is applied to a B key (white key for a pitch B) of the keyboard apparatus, for example. The construction of the key structure 600 may be applied not only to a white key but also to a black key. In the following description, a side of the key structure 600 toward the player will be referred to as "the front side" and a right side of the same as viewed from the player will be referred to as "the right side".

The key structure 600 is comprised of an upper plate body (support member) 110 made of synthetic resin and formed in one piece by molding, and a wood part 111 made of wood. As shown in FIG. 1A, the upper plate body 110 has substantially the same elongated shape in plan view as the B key, except for a rear end part 110B thereof. The key structure 600 has a front end part thereof pivotally vertically movable about a pivot 119 (see FIG. 1B) in the rear end part 110B of the upper plate body 110.

The wood part 111, which has approximately the same length as a front part of the upper plate body 110, extends forward of the rear end part 110B, and is fixedly bonded to the underside surface of the front part of the upper plate body 110 such that a longitudinal clearance CL1 is provided between the wood part 111 and the rear end part 110B. The clearance CL1 serves mainly to accommodate variations in the longitudinal dimensions of the wood part 111 and the rear end part 110B, and also to prevent expansion and contraction or deformation of the wood part 111 due to changes in the environment from causing degradation of the bonded status of the wood part 111 and the upper plate body 110. The wood part 111 is made of an elongated wood block, and has the same width as that of the upper plate body 110 with the same side profiles as those of the latter, such that the wood part 11 is exposed to opposite side surfaces of the key structure 600.

The wood part 111 plays the role of making the key structure 600 present a woody appearance. When an adjacent key is depressed, a side surface of the key structure 600 is exposed to the view of the player. The wood part 111 made of wood is disposed such that it is visually recognized as part of a side of the key structure 600 when the adjacent key is depressed, so that the key structure 600 appears as if it were made of wood except for its upper and front surfaces. This makes the key structure 600 present a woody appearance and hence a high-quality appearance.

As shown in FIG. 1A, a region AR1 of the key structure 600 rearward of the rear end of the wood part 111 includes the rear end part 110B of the upper plate body 110, but does not include any part of the wood part 111. Opposite lateral sides 110*c* and 110*d* of the upper plate body 110 except a wide player-side end part thereof have respective recessed parts 110*a* and 110*b* formed in a region AR2 which occupies an approximately entire region of the entire region AR1, such that the recessed parts 110*a* and 110*b* are recessed transversely inward with respect to respective lateral sides 111*a* and 111*b* (see FIG. 1C) of the narrow part 111M of the wood part 111. Therefore, the width J1 of the upper plate body 110 in the region AR2 is smaller than the width W1 of the narrow part 111M of the wood part 111. The upper plate body 110 is formed in one piece by molding as described above, and therefore the recessed parts 110*a* and 110*b* are also formed at the same time when the upper body 110 is molded.

On the other hand, the narrow part 111M of the wood part 111 is formed by machining, i.e. cutting. Before machining, the width of the wood part 111 is set to be larger than a predetermined width thereof. For example, the wood part 111 is initially formed such that it has the same width set to the width of the wide player-side end thereof along the length thereof from the front end to the rear end. Then, after the wood part 111 is fixedly bonded to the upper plate body 110, the narrow part 111M is machined such that it has the same width as that of the B key of the keyboard apparatus, and thus the narrow part 111M forms a narrowest part of the wood part 111. The machining for width adjustment is performed by cutting the wood part 111 using a cutting tool, such as a rotary tool, which is moved longitudinally.

The above-mentioned recessed parts 110*a* and 110*b* formed in the rear end part 110B of the upper plate body 110 makes it possible to avoid interference of the blade of the cutting tool with the rear end part 110B. More specifically, while the rear end part 110B has a wide part thereof formed of synthetic resin in side view, the machining is carried out under machining conditions (cutting conditions including feeding speed, cutting speed, and so forth) suitable for the wood part 111. Further, the machining is generally performed by clamping the region including the wood part 111 but without clamping the rear end part 110B.

On the other hand, if the recessed parts 110*a* and 110*b* were not formed, the blade of the cutting tool interferes with the rear end part 110B. Therefore, the provision of the recessed parts 110*a* and 110*b* makes it possible to prevent the rear end part 110B in the region AR2 from being cracked, chipped, or damaged. Further, since the rear end part 110B is not a visible part which can be seen from the outside during performance, the appearance of the key structure 600 cannot be adversely affected by the rear end part 110B. The recessed parts 110*a* and 110*b* may be formed so as to extend along the entirety of the region AR1 where the wood part 111 does not exist, or beyond the region AR1.

As shown in FIGS. 1B and 1C, the upper plate body 110 has a rib 112 integrally formed therewith, which has a triangular shape in side view. The rib 112 is formed such that it extends from the rear end part 110B of the upper plate body 110 toward the player side and the wood part 111, with opposite side surfaces thereof being longitudinally and vertically in substantial parallel relationship. The vertical thickness (height) of the rib 112 increases toward the rear side of the rib 112. More specifically, the rib 112 has a player-side lower end (a sloped surface facing obliquely forward and downward) thereof sloped rearward and downward. On the other hand, the wood part 111 has a groove 113, which has a width large enough to have the rib 112 fitted therein, formed at a location corresponding to the rib 12. The rib 112 is slidably fitted or received in the groove 113 when the wood part 111 is bonded to the upper plate body 110. At this time, a clearance CL2 is formed between the bottom of the groove 113 and the sloped player-side lower end of the rib 112. The clearance CL2 plays the same role as the clearance CL1.

According to the present embodiment, when an adjacent key is depressed, the wood part 111 of the key is viewed as part of a side of the key by the player, which gives a woody appearance and hence a high-quality appearance to the key. Further, in the substantial entirety (region AR2) of the region AR1 where the wood part 111 does not exist, the recessed parts 110*a* and 110*b* are formed in the rear end part 110B, which makes it possible to avoid interference of the cutting tool with the rear end part 110B during the machining of the wood part 111 for width adjustment, to thereby prevent damage to the upper plate body 110.

Further, according to the present embodiment, since the upper plate body 110 is formed with the rib 112, the upper plate body 110 itself has enhanced rigidity and enhanced uniformity of rigidity. Furthermore, since the rib 112 is formed in a manner connecting between the rear end part 110B and the wood part 111 through the clearance CL1, the weakest part of the key structure 600 is effectively reinforced, which enhances the rigidity and uniformity-thereof in the entire key structure 600 in the longitudinal direction. Moreover, the thickness of the rib 112 progressively increases from a front end of the rib 112, where the rib 112 has no thickness, toward a rear end thereof and continues to the rear end part 110B, which prevents stress caused by key depression from being concentrated on a particular part of the key structure in the longitudinal direction, thereby dispersing the stress to make the rigidity of the key structure 600 further uniform, leading to enhanced durability of the key structure 600. In addition, since the rib 112 is received in the groove 113 of the wood part 111, the overlap of the two components mainly in the longitudinal direction promotes space saving, compared with a structure in which the rib 112 is not received in the wood part 111, which contributes to reduction of the size of the key structure 600.

The rib 112 may have a rectangular shape in side view instead of a triangular shape in side view, which also makes it possible to obtain enhanced rigidity of the key structure 600. However, considering the fact that the key structure 600 has a sufficient degree of rigidity in the region where the rib 112 is fitted in the groove 113 of the wood part 111, but a lowest degree of rigidity in the region of the clearance CL1, the rib 112 is formed in the present embodiment such that the vertical thickness (height) thereof is maximized in the region of the clearance CL1 and progressively decreased toward the front end of the rib 112, whereby discontinuous variations in the rigidity of the key structure 600 in the longitudinal direction are minimized to thereby make the rigidity as uniform as possible, and at the same time, the region of the wood part 111, where the groove 113 is formed, is minimized in area and volume to thereby reduce the amount of groove machining.

The term "substantial parallel relationship" between the opposite side surfaces of the rib 112 in the vertical direction includes tolerances of an angle between the opposite side surfaces of the rib 112, which may be 1 to 10 times as large as the draft angle of the mold (i.e. an angle of not larger than eight degrees).

Next, a description will be given of a second embodiment of the present invention, which is distinguished from the first embodiment in which the upper plate body 110 is used as a support member that fixedly supports the wood part 111, in that a key base body is used as a support member.

Figure 2A:
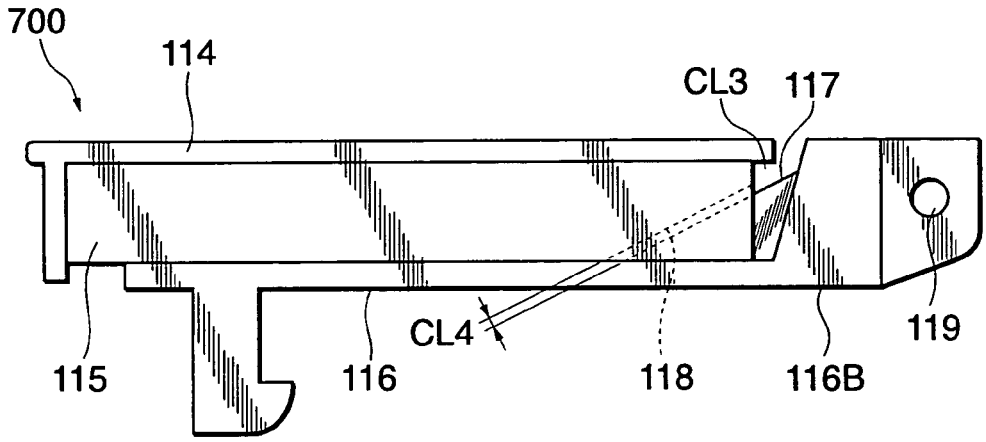
FIG. 2A is a side view of a key structure according to a second embodiment of the present invention.
Figure 2B:
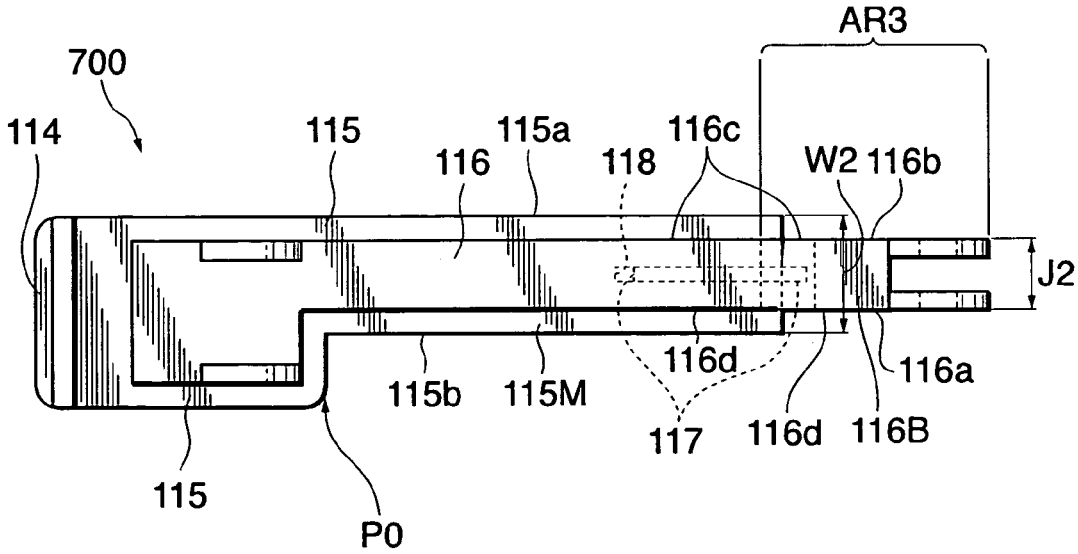
FIG. 2B is a bottom view of the key structure according to the second embodiment.

FIG. 2A is a side view of a key structure according to the second embodiment, and FIG. 2B is a bottom view of the same.

The key structure 700 of the second embodiment is also applied to a B key, for example. The construction of the key structure 700 may be applied not only to a white key but also to a black key. In the following description, a side of the key structure 700 toward the player will be referred to as "the front side" and a right side of the same as viewed from the player will be referred to as "the right side".

The key structure 700 is comprised of an upper plate body 114 and a key base body (support member) 116, each of which is formed of synthetic resin and formed by the mold, and a wood part 115 made of wood. As shown in FIG. 2A, the upper plate body 114 has substantially the same elongated shape in plan view as the B key, except that the upper plate body 114 does not have a part corresponding to a rear end part of the B key.

The wood part 115 has approximately the same length as the wood part 111 in the first embodiment, and is fixedly bonded to the lower surface of the upper plate body 114 and the upper surface of a part of the key base body 116 extending forward of a rear end part 116B of the same, such that a clearance CL3 having a longitudinal component is provided between the wood part 115 and the rear end part 116B. The clearance CL3 plays the same role as the clearance CL1 (see FIG. 1B). The key structure 700 has a front end part thereof pivotally vertically movable about a pivot 119 in the rear end part 116B of the key base body 116.

As shown in FIG. 2B, the wood part 115 does not exist at all in a rear end part of the key structure 700 in the longitudinal direction. The key base body 116 has a uniform width J2 except a wide player-side end part. On the other hand, a part of the wood part 115 other than a wide player-side end part thereof, i.e. a narrow part 115M, has a uniform width W2. The uniform width W2 is larger than the uniform width J2 (W2>J2). Therefore, when focusing attention on the rear end part 116B of the key base body 116, opposite lateral sides 116*c* and 116*d* of the part of the key base body 116 having the width J2 include respective sides (recessed parts) 116*a* and 116*b* in a region AR3 of the key structure, where the wood part 115 does not exist, and the opposite lateral sides 116*a* and 116*b* are recessed transversely inward with respect to respective lateral sides 115*a* and 115*b* of the narrow part 115M of the wood part 115. Thus, when the wood part 115 is machined for width adjustment, the sides 116*a* and 116*b* play the same role as that played by the recessed parts 110*a* and 110*b* of the key structure according to the first embodiment, whereby interference of the blade of the cutting tool with the rear end part 116B can be avoided.

Further, as shown in FIGS. 2A and 2B, the key base body 116 has a rib 117 formed integrally therewith, which has a triangular shape in side view. The rib 117 has a shape in vertically symmetrical relationship with the rib 112 in the first embodiment, but the function thereof is the same as that of the rib 112. However, as is distinct from the rib 112 which is continuous with the upper plate body 114, the rib 117 extends from the key base body 116, and therefore a sink mark formed at the root of the rib 117 appears on the lower surface of the key base body 116, not on the upper surface (top surface) of the upper plate body 114. Therefore, the second embodiment is more advantageous than the first embodiment in that it is possible to prevent a sink mark from being formed on a visible part visible from the outside during performance to thereby avoid degradation of the appearance of the visible part.

In association therewith, the wood part 115 has a groove 118 having a width large enough to have the rib 117 fitted therein, formed at a location corresponding to the rib 117. Further, a clearance CL4 is formed between the groove 118 and a sloped player-side upper end (a sloped surface facing obliquely forward and upward). The fitting and receiving relationship between the rib 117 and the groove 118 is similar to that between the rib 112 and the groove 113 in the first embodiment, and the clearance CL4 plays the same role as the clearance CL2.

According to the present embodiment, it is possible not only to provide the same advantageous effects as provided by the first embodiment, but also to prevent generation of a sink mark on the upper surface of the upper plate body 114, thereby ensuring excellent appearance of the upper plate body 114.

In the present embodiment, the key base body 116 is has the uniform width J2 except the wide player-side end part. However, from the viewpoint of prevention of damage to the rear end part 116B of the key base body 116 during machining of the wood part 115 for width adjustment, it suffices to make the width of the rear end part 116B smaller than the width W2 of the narrow part 115M of the wood part 115 only in the substantially entire region of the region AR3 where the wood part 115 does not exist, so as to provide the rear end part 116B with recesses which are indented transversely inward with respect to the narrow part 115M.

Figure 3A:
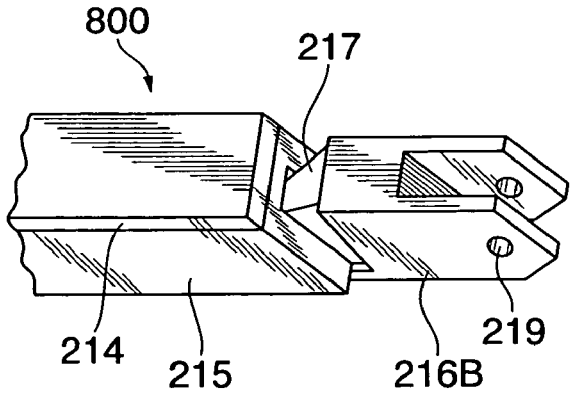
FIG. 3A is a perspective view of a rear part of a key structure according to a third embodiment of the present invention.
Figure 3B:
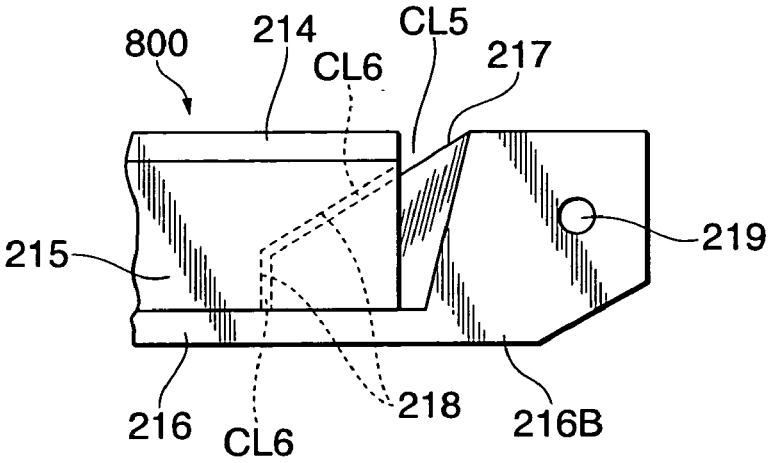
FIG. 3B is a side view of the rear part of the key structure according to the third embodiment.
Figure 3C:
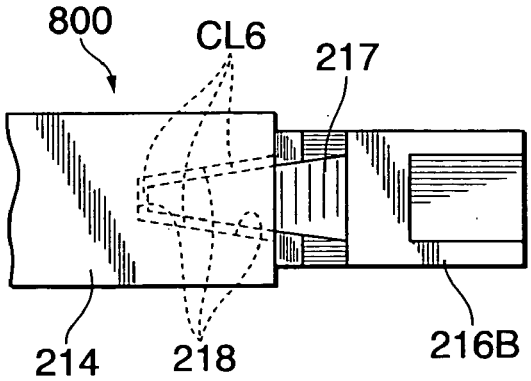
FIG. 3C is a plan view of the rear part of the key structure according to the third embodiment.

FIG. 3A is a perspective view of a rear part of a key structure according to a third embodiment of the present invention. FIG. 3B is a side view of the rear part of the key structure, and FIG. 3C is a plan view of the same.

The third embodiment is distinguished from the second embodiment in which the rib 117 is in the form of a thin plate having the opposite side surfaces thereof longitudinally and vertically in substantial parallel relationship, in that a rib 217 of the key structure 800 according to the third embodiment has a trapezoidal shape in plan view. The key structure 800 is comprised of an upper plate body 214, a wood part 215, a key base body (support member) 216, a rear end part 216B of the key base body 216, and a pivot 219, which are slightly different in shape but basically identical in construction to the upper plate body 114, the wood part 115, the key base body 116, the rear end part 116B of the key base body 116, and the pivot 119, of the key structure 700, respectively, of the second embodiment.

As shown in FIG. 3B, between the rear end part 216B of the key base body 216 and the wood part 215, there is provided a clearance CL5 having a longitudinal component. The clearance CL5 plays the same role as the clearance CL3 (see FIG. 2A). As shown in FIG. 3C, the rib 217 has a thickness in the transverse direction of the key (transverse direction), which increases toward a rear end of the rib 217, i.e. the rib is into a trapezoidal shape in plan view, with a rear side thereof as a lower base. The rib 217 need not have a front side, in plan view, that is, the rib 217 may have a triangular shape with a sharpened front part, in plan view. In side view, as shown in FIG. 3B, the rib 217 has a player-side upper end (a sloped surface facing obliquely forward and upward) sloped upward toward the rear end thereof, that is, the rib 217 has a vertical thickness increasing toward the rear end thereof. In side view, the rib 217 may have a triangular shape with a sharpened front part similarly to the rib 117.

On the other hand, the wood part 215 has a recess 218 where the rib 217 is loosely fitted, formed at a location corresponding to the recess 218. Further, as shown in FIGS. 3B and 3C, a clearance CL6 is provided between the sloped player-side upper end, a front end, and opposite side surfaces of the rib 217 and the recess 218. Since the rib 217 has a trapezoidal shape, the clearance CL6 is provided not only in the longitudinal direction, but also in the transverse direction so as to play the same role as that of the clearance CL4 (see FIG. 3C). The rib 217 is loosely fitted or received in the recess 218.

According to the present embodiment, it is possible to provide the same advantageous effects as provided by the second embodiment. Further, since the thickness of the rib 217 in the transverse direction progressively increases toward the rear end thereof, it is possible to enhance torsional rigidity of the key structure 800, thereby increasing rolling resistance of the same. Particularly in B, C, E, and F keys, the difference in position between the center of the wide player-side front half of the key in the transverse direction and that of the narrow rear half of the same in the same direction is large (i.e. the degree of transverse asymmetry is high), and therefore the key tends to undergo a large load in the rolling direction during performance. An oblique component of the rib 217 produced with respect to the center of the key in the transverse direction due to the trapezoidal shape of the lib 217 in plan view can act effectively against the torsional load to suppress rolling.

In the first and second embodiments as well, with a view to suppressing the rolling, the rib 112 (117) may be formed such that the opposite side surfaces thereof longitudinally extend not in parallel relationship but slightly obliquely with respect to the center in the transverse direction (the longitudinal axis), or a pair of ribs 112 (117) may be formed such that they form the same angle as formed by the opposite side surfaces of the rib 217. Alternatively, another rib having an oblique component may be formed in addition to the rib 112 (117).

Although in the third embodiment, the opposite side surfaces of the rib 217 vertically extend in parallel relationship, this is not limitative, but the opposite side surfaces may extend vertically at an angle 1 to 10 times as large as the draft angle of the mold (i.e. an angle of not larger than eight degrees), for example, such that the thickness of the rib 217 in the transverse direction increases toward a lower end of the rib 217. This configuration makes it possible to prevent distortion or stress caused by the load in the rolling direction from being concentrated on a specific part of the key structure, whereby the rolling resistance can also be made uniform. When this configuration is reflected in the key structure 800 in FIGS. 3A to 3C, the thickness of the rib 217 in the transverse direction increases toward the key base body 216.

Although in the first to third embodiments described hereinabove, the upper plate body or the key base body is used as a support member that fixedly supports the wood part, this is not limitative, but the present invention is applicable to a case where the upper plate body and the key base body are formed in one piece so as to serve as the support member. Alternatively, the present invention can be applied to a configuration in which the upper plate body and the key base body are formed in separate bodies, with the rear end parts of the two members lying at a location corresponding to the rear end part of the key structure but the wood part not existing there, and the rear end parts of the two members are both formed in a fashion being recessed laterally inward of the narrow part of the wood part, whereby damage to the rear end parts can be prevented.

In the first to third embodiments described hereinabove, insofar as the presentation of the woody appearance is concerned, the wood part need not be formed of wood, but it can be formed of a woody material. For example, a woodgrain decorative panel (a printed panel, a coated panel, a painted panel, sliced veneer), plywood, a medium density fiberboard (MDF), or the like may be employed.

Although the key base body 116 in the second embodiment is used for the B key, if the key base body 116 is formed into such a shape that it can be applied to any of an A key, a C key, an E key, and a G key, the key base body 116 can also be used for the key structure of a corresponding dash key.

Dash keys are white keys which are disposed at the left and right ends of a keyboard, with no black keys provided outward thereof. For example, in an 88-key keyboard, the pitch of the lowest-pitch key is "A" and that of the highest-pitch key is "C". In a 76-key keyboard, the pitch-of the lowest-pitch key is "E" and that of the highest-pitch key is "G". Now, taking as an example the lowest-pitch key (A key) as the left-end dash key in the 88-key keyboard, each of the other A keys than the dash key has a left side part thereof formed with an recessed part to avoid interference with a left adjacent black key of the pitch "G#", but the A dash key, which need not be formed with a recessed part, is different in shape in plan view from the non-dash keys.

However, since the dash key has a shape in plan view which is larger in thickness than the corresponding non-dash key, if only a key base body for the dash key is formed into the same shape as that of the key base body 116 of the key structure shown in FIG. 2B, of which the upper plate body 114 and the wood part 115 are designed for a dash key, or more specifically, if the key base body for the dash key is shaped in plan view such that the key base body except the rear end part 116B is hidden by the upper plate body 114 and the wood part 115 as viewed from above, the key base body is not visible from outside even when it is combined with the upper plate body and the wood part of a non-dash key, so that the key base body cannot cause any problem which spoils the appearance. Further, since even the narrow part of the wood part of the non-dash key is wider than that of the wood part of a non-dash key, it is possible to avoid interference of the cutting blade with the rear end part of the key base body when the wood part is machined for width adjustment, thereby preventing damage to the key base body.

As described above, the key base body for a non-dash key of any of the pitches A, C, E and G can be used for both a non-dash key and a dash key, by being selectively combined with the upper plate body and the wood part for the non-dash key and those for the dash key, which contributes to reduction of the number of component parts and elements. This is the same with the key base body 216 of the key structure 800 of the third embodiment.

What is claimed is:

1. A key structure that is mounted in a keyboard apparatus, for functioning as a key pivotally moved by key depression, comprising:

a wood part that includes a narrow part having opposite lateral sides; and an elongated support member that has opposite lateral sides, and fixedly supports said wood part, wherein said support member has recessed parts formed in the respective lateral sides thereof at least in a substantial entirety of a region of said support member in a longitudinal direction where said wood part does not exist, said recessed parts being recessed laterally inward of the respective lateral sides of the narrow part of said wood part.

2. A key structure as claimed in claim 1, wherein:

said wood part includes an upper part, said support member comprises an upper plate part that has a top surface used as a depressing surface, and is disposed on said upper part of said wood part, and a key base body that supports said wood part from below, said key base body having a shape in plan view such that said key base body is applicable to any of the keys for a pitch A, a pitch C, a pitch E, and a pitch G, as non-dash keys which are disposed in positions other than opposite ends of the keyboard apparatus, and said key base body is configured for use in both any of dash keys for the pitch A, the pitch C, the pitch E, and the pitch G, disposed at the opposite ends of the keyboard apparatus, and any of the non-dash keys, in a manner such that said key base body selectively supports said wood part and said upper plate part that are configured for said dash keys, and said wood part and said upper plate part that are configured for said non-dash keys.

3. A key apparatus comprising keys having a key structure as claimed in claim 1.

4. A key structure that is mounted in a keyboard apparatus, for functioning as a key pivotally moved by key depression, comprising:

a wood part;

an elongated support member that has a rear part, and fixedly supports said wood part; and a rib that has opposite lateral side surfaces and extends from said rear part of said support member toward a player side and said wood part, wherein said wood part has a recess formed therein, in which said rib is fitted or received, and wherein the elongated support member and the rib are each made of resin.

5. A key structure as claimed in claim 4, wherein at least one of the thickness of said rib in a vertical direction thereof and the thickness of said rib in transverse direction of the key increases toward a rear end of said rib.

6. A key structure as claimed in claim 4, wherein the thickness of said rib in a transverse direction of the key increases toward said support member.

7. A key apparatus comprising keys having a key structure as claimed in claim 4.

8. A key structure that is mounted in a keyboard apparatus, for functioning as a key pivotally moved by key depression, comprising:

an elongated support member that has a rear part;

a wood part that is fixedly supported by said support member, said wood part being disposed at a location forward of said rear part of said support member such that said wood part extends toward a player side, with a clearance provided between said rear part of said support member and said wood part, said clearance having a longitudinal component; and a rib that has opposite lateral side surfaces and extends from said rear part of said support member toward the player side and said wood part at least in the clearance; and wherein said wood part has a recess formed therein, in which said rib is fitted or received.

9. A key apparatus comprising keys having a key structure as claimed in claim 8.

* * * * *